US005497747A

United States Patent [19]

Nakano et al.

[11] Patent Number: 5,497,747

[45] Date of Patent: Mar. 12, 1996

[54] ENGINE WITH MECHANICAL GOVERNOR

[75] Inventors: Keiichi Nakano; Kiyoshi Doi; Kiyonobu Iida; Naoki Inoue, all of Sakai, Japan

[73] Assignee: Kubota Corporation, Osaka, Japan

[21] Appl. No.: 305,958

[22] Filed: Sep. 16, 1994

[30] Foreign Application Priority Data

Sep. 17, 1993 [JP] Japan ..... 5-230662

[51] Int. Cl.[6] ..... F02D 31/00

[52] U.S. Cl. ..... 123/363

[58] Field of Search ..... 123/363, 364, 123/379

[56] References Cited

U.S. PATENT DOCUMENTS

| | | | |
|---|---|---|---|
| 4,697,557 | 10/1987 | Tamba et al. | 123/363 |
| 5,065,720 | 11/1991 | Nishiyama et al. | 123/363 |

FOREIGN PATENT DOCUMENTS

| | | | |
|---|---|---|---|
| 53-20593 | 5/1978 | Japan | 123/363 |
| 55-159408 | 11/1980 | Japan . | |
| 63-147934 | 6/1988 | Japan | 123/363 |
| 5-149160 | 6/1993 | Japan | 123/363 |
| 5-240078 | 9/1993 | Japan | 123/363 |

*Primary Examiner*—David A. Okonsky
*Attorney, Agent, or Firm*—Bacon & Thomas

[57] ABSTRACT

A bearing boss (3) is protruded from a front wall (2) of a crankcase (1), and a crankshaft (4) is supported at its front journal portion (5) by this bearing boss (3). Interlocking shafts (7) are disposed within the crankcase (1) in parallel to the crankshaft (4), and a crank gear (6) and input gears (8) attached to the interlocking shafts (7) are arranged coplanarly. Balancer shafts (11) are used as the interlocking shafts (7), governor weights (9) are mounted to the rear surface (12) of the input gear (8), and a governor sleeve (10) is located behind the governor weights (9).

4 Claims, 4 Drawing Sheets

ENGINE WITH MECHANICAL GOVERNOR

BACKGROUND OF THE INVENTION

1. Field of the Invention

The present invention relates to an engine with a mechanical governor.

2. Description of Prior Art

A general constitution of an engine with a mechanical governor is as follows. That is, a bearing boss is protruded from a front wall of a crankcase, a crankshaft is supported at its front journal portion by this bearing boss, and a crank gear is mounted to the crankshaft in front of the bearing boss. Further, an interlocking shaft is disposed within the crankcase in parallel to the crankshaft and an input gear is mounted to this interlocking shaft. The crank gear and the input gear are arranged coplanarly, governor weights are mounted to the input gear and a governor sleeve is mounted to the interlocking shaft.

Usually, this kind of engine uses a valve actuating cam shaft as the interlocking shaft to which the governor sleeve is mounted. In the case of a four cycle engine, since the valve actuating cam shaft is rotated at a half speed of that of the crankshaft, it is necessary to increase a centrifugal force by making a governor weight heavier for obtaining a sufficient governor force, that results in an enlargement of the governor weight. Therefore, the governor weight can't be accommodated entirely within a space defined by the bearing boss behind the input gear, thus the governor weights are mounted to the front surface of the input gear and the governor sleeve is mounted in front of the governor weights. In a diesel engine, also when a fuel injection cam shaft is used as the interlocking shaft to which the governor sleeve is mounted, they are similarly arranged.

SUMMARY OF THE INVENTION

It is an object of the present invention to provide a compact engine with a mechanical governor.

For accomplishing the above-mentioned object, the present invention is constituted as follows.

For example, as shown in FIG. 1 corresponding to an embodiment of the present invention, a bearing boss 3 protruded from a front wall 2 of a crankcase 1, and a crankshaft 4 is supported at its front journal portion 5 by this bearing boss 3. Further, a crank gear 6 is attached to the crankshaft 4 in front of the bearing boss 3, an interlocking shaft 7 is disposed within the crankcase 1 parallel to the crankshaft 4, and an input gear 8 attached to this interlocking shaft 7. The crank gear 6 and the input gear 8 are arranged coplanarly, governor weights 9 are mounted to the input gear 8, and a governor sleeve 10 is mounted to the interlocking shaft 7.

A balancer shaft 11 is used as the interlocking shaft 7 to which the governor sleeve 10 is mounted, the governor weights 9 are mounted to the rear surface 12 of the input gear 8, and the governor sleeve 10 is located behind the governor weights 9.

According to the present invention having the abovementioned constitution, the following advantages can be obtained.

That is, since the balaneer shaft 11 rotates at the same speed as that of the crankshaft 4 in the ease of a primary balancer and rotates at a double speed relative to the crankshaft 4 in the case of a secondary balancer, even the light governor weights 9 produce a large centrifugal force so that a sufficient governor force can be obtained. Therefore, since the governor weights 9 can be made small so that the governor weights 9 and the governor sleeve 10 can be accommodated within a space 23 defined by the bearing boss 3 behind the input gear 8, a compact constitution of the engine can be accomplished.

BRIEF DESCRIPTION OF THE DRAWINGS

The above and other objects, advantages and features of the invention will become apparent when considered with the following specification and accompanying drawings wherein.

DESCRIPTION OF THE PREFERRED EMBODIMENTS

Figure 1:
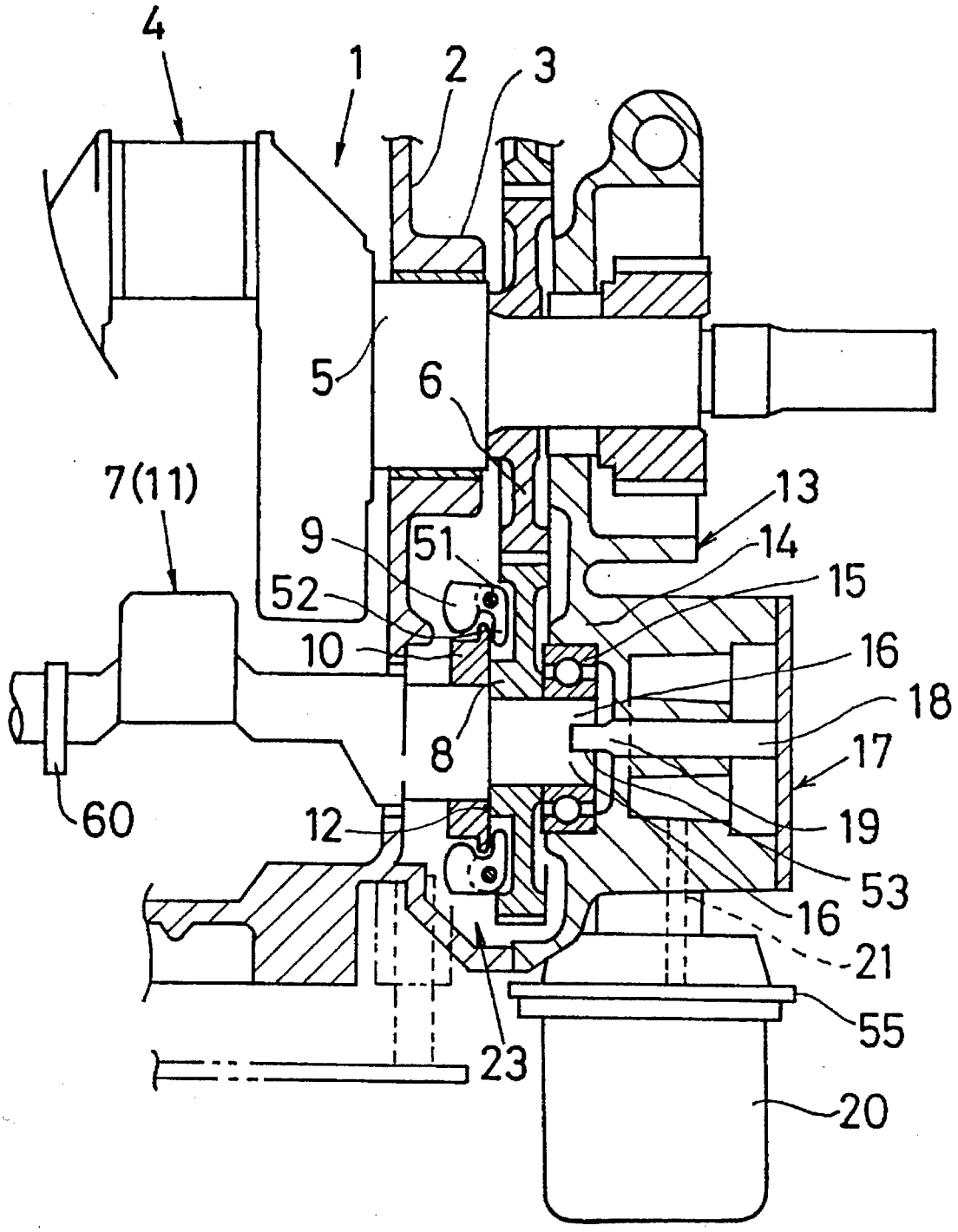
FIG. 1 is a horizontal sectional plan view of a principal portion of an engine according to an embodiment of the present invention.

An embodiment of the present invention will be explained with reference to the accompanying drawings. All of FIGS. 1 through 4 are explanatory views of the embodiment of the present invention. An engine used in this embodiment is a four-cycle vertical water-cooled two-cylinder gasoline engine of an overhead earns type. A constitution of this engine is as follows. That is, as shown in FIG. 4, a cylinder head 26 is mounted to an upper portion of a cylinder block 25, and a gear case 13 and a belt case 27 are mounted to a front portion of the cylinder block 25.

Figure 2:
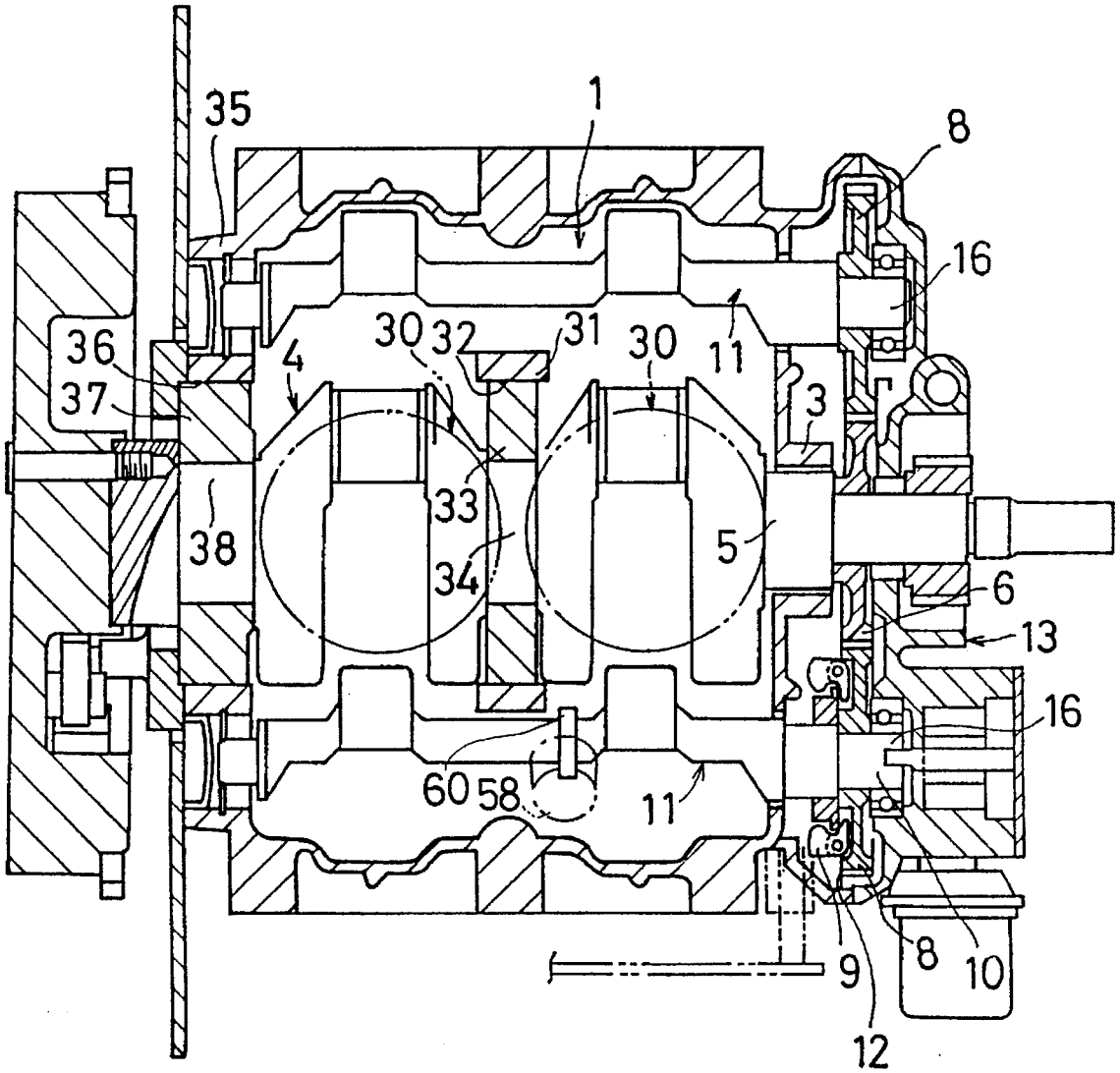
FIG. 2 is a horizontal sectional plan view of the engine according to the embodiment of the present invention.

A cooling fan 28 is mounted to a front portion of the belt case 27, and a radiator in front of the cooling fan 28. As shown in FIG. 2, a crankshaft 4 is disposed within a crankcase 1 formed in a lower portion of the cylinder block 25. In this crankshaft 4, a crankpin angle is set to 0° and ignitions in respective cylinders 30, 30 are performed every 360° at a crank angle in order.

A bearing constitution for the crankshaft 4 of this engine is as follows. That is, as shown in FIG. 2, a middle partition wall 31 is disposed in a mid portion of the crankcase 1 in the front and rear direction and is provided with a middle bearing bore 32 so that a middle journal portion 34 of the crankshaft 4 is supported by a middle bearing case 33 fitted into this bore 32. A rear bearing bore 36 is formed in a rear wall 35 of the crankcase 1 so that a rear journal portion 38 of the crankshaft 4 is supported by a rear bearing ease 37 fitted into this bore 36.

A bearing boss 3 is protruded forward from a front wall 2 of the crankcase 1 so that a front journal portion 5 of the crankshaft 4 is supported by this bearing boss 3. A crank gear 6 is externally fixedly fitted to the crankshaft 4 in front of the bearing boss 3.

In this engine, a pair of balancer shafts 11, 11 are disposed in parallel to the crankshaft 4 on both the left and right sides thereof within the crankcase 1. These balancer shafts 11, 11 are primary balancers. Input gears 8 are fixedly fitted to front end portions 16, 16 of these balancer shafts 11, 11. Both these input gears 8 are arranged coplanarly with respect to the crank gear 6 and accommodated within the gear case 13.

This engine is provided with a mechanical governor which has the following constitution. That is, as shown in FIG. 4, a governor lever 42 is attached swingably to the lateral side of the cylinder block 25 through a governor shaft 41, and a throttle valve of a carburetor 45 is connected interlockingly to a swinging end portion 43 of the governor lever 42 through an interlocking rod 44. The governor lever 42 is connected interlockingly to a speed control lever 47 through a governor spring 46 and urged toward a fuel increasing side by a spring force 48 of the governor spring 46.

Figure 3:
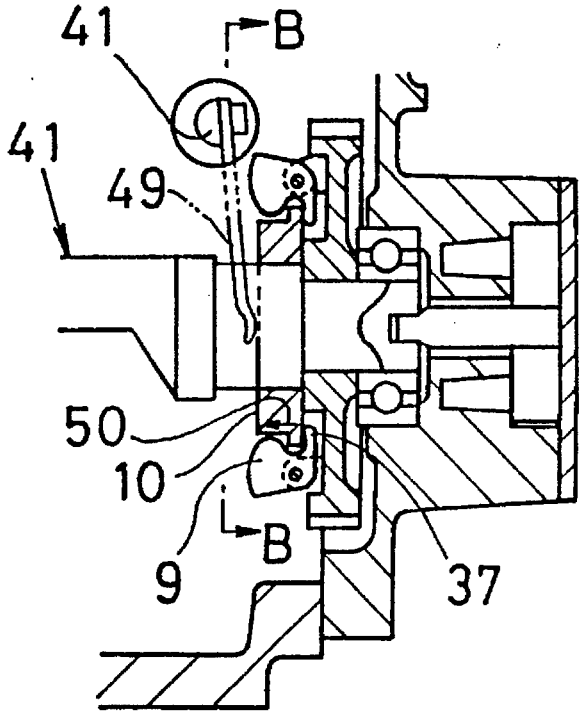
FIG. 3 is an explanatory view of a mechanical governor used in the engine according to the embodiment of the present invention, FIG. 3 (A) is a vertical sectional side view of a principal part, and FIG. 3 ( B ) is a sectional taken along the B—B line in FIG. 3(A)
Figure 3:
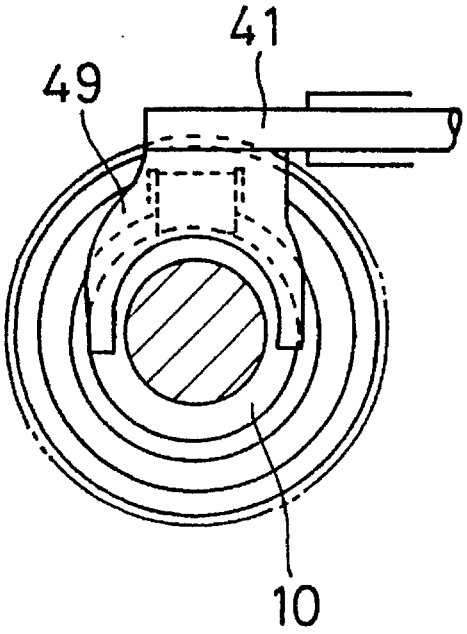
Figure 4:
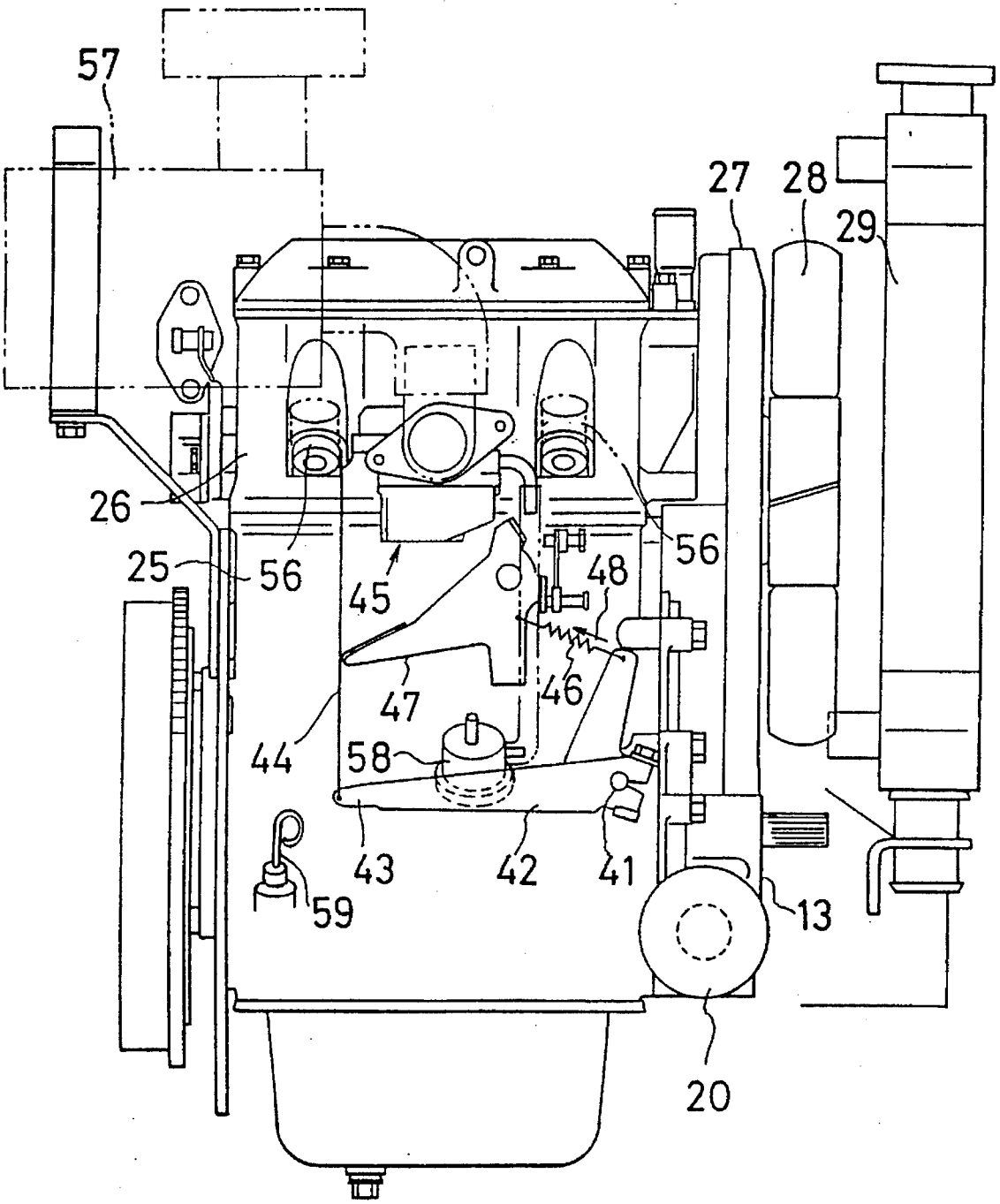
FIG. 4 is a side view of the engine according to the embodiment of the present invention.

Further, as shown in FIG. 3, a fork lever 49 is attached to the governor shaft 41 so that a governor force 50 to be given by governor weights 9 is transmitted to the fork lever 49 through a governor sleeve 10 to apply a force acting in the fuel decreasing direction onto the governor lever 42 through the governor shaft 41.

In this embodiment, in order to downsize the engine, the following constitution is employed. That is, as shown FIG. 2, the governor weights 9 are mounted to the rear surface of the input gear 8 of the left balancer shaft 11, and the governor sleeve 10 located behind the governor weights 9. As shown in FIG. 1, the governor weights 9 are supported swingably by weight pivots 51 so that their output end portions 52 can be brought into contact with the front end surface of the governor sleeve 10 from foreside. The governor sleeve 10 is externally fitted to the balancer shaft 11 so as to be slidable in the front and rear direction.

According to this constitution, the following advantages can be obtained. That is, since the balancer shaft 11 rotates at the same speed as that of the crankshaft 4, even the light governor weights can produce a large centrifugal force so that a sufficient governor force can be obtained. Therefore, since the governor weights 9 can be downsized and the governor weights 9 and the governor sleeve 10 can be accommodated within a space 23 defined by the bearing boss 3 behind the input gear 8, a downsizing of the engine can be attained.

In this embodiment, since bearing portions 15 are disposed in a front wall 14 of the gear case 13 covering the crank gear 6 and the input gears 8 to support the front end portions 16 of the balancer shafts 11 by these bearing portions 15 so that the input gears 8 and the bearing portions 15 can be made close to each other, load moments exerted from the input gears 8 to the bearing portions 15 become small. Accordingly, the bearing portion 15 of the balancer shaft 11 can be downsized and its manufacturing cost can be reduced.

Further, in this embodiment, since a lubricating oil pump 17 is disposed in the front wall 14 of the gear case 13 in front of the bearing portion 15 and an input shaft 18 of this lubricating oil pump 17 is connected at its rear end portion 19 to the front end portion 16 of the balancer shaft 11 by the Oldham's coupling 53 so that the balancer shaft 11 can be used not only as a slide guide shaft of the governor sleeve 10 but also as a drive shaft of the lubricating oil pump 17, it becomes unnecessary to provide these slide guide shaft and drive shaft separately to decrease the number of component parts. A fuel supply earn 60 attached to a midway portion of the balancer shaft 11 so that an input portion of a fuel supply injection pump 58 (refer to FIG. 4) can be brought into contact with the cam 60, also it becomes unnecessary to provide a fuel supply cam shaft separately.

In this embodiment, an element mounting seat 55 is arranged on the lateral side of the gear case 13 and an oil filter element 20 can be detachably mounted onto this seat 55. The oil filter element 20 is connected to the lubricating oil pump 17 through an oil passage 21 formed in the gear case 13, and the oil filter element 20 and the lubricating oil pump 17 are concentrated to the gear case 13. Therefore, the oil passage 21 connecting these element 20 and pump 17 to each other can be made short and its formation becomes ready.

Further, in this embodiment, as shown in FIG. 4, a pair of ignition plugs 56, 56, an air cleaner 57, the carburetor 45, the fuel supply injection pump 58, the speed control lever 47, the governor lever 42, an oil level gauge 59 and the oil filter element 20 are collected on the left side of the engine so that the maintenance for the engine can be readily carried out.

Though the constitution of the embodiment of the present invention is as mentioned above, the present invention is not limited to the above-mentioned embodiment. Though the vertical water-cooled two-cylinder gasoline engine of the overhead earn type has been explained in the above-mentioned embodiment, the present invention can be applied also to engines with mechanical governors of other types. Therefore, the present invention can be applied to various kinds of engines such as a horizontal engine, an overhead valve engine, an air-cooled engine, a liquid-cooled engine, a single-cylinder engine, a multi-cylinder engine having at least two cylinders.

What is claimed is:

1. An engine with a mechanical governor comprising:

a bearing boss (3) protruding from a front wall (2) of a crankcase (1);

a crankshaft (4) supported at front journal portion (5) by the bearing boss (3);

a crank gear (6) attached to a crankshaft (4) on a side of the front wall (2) opposite the crankcase (1);

an interlocking shaft (7) disposed within the crankcase (1) and extending through said front wall (2) in parallel to the crankshaft (4);

an input gear (8) attached to the interlocking shaft (7) with the crank gear (6) and the input gear (8) arranged coplanarly;

a governor weight (9) mounted to the input gear (8);

a governor sleeve (10) mounted to the interlocking shaft (7);

a balancer shaft (11) being used as the interlocking shaft (7) to which the governor sleeve (10) is mounted, the governor weight (9) being mounted to the rear surface (12) of the input gear (8), and the governor sleeve (10) being located behind the governor weight (9).

2. An engine with a mechanical governor as set forth in claim 1, wherein a bearing portion (15) is disposed in a front wall (14) of a gear case (13) covering the crank gear (6) and the input gear (8), and a front end portion (16) of the balancer shaft (11) is supported by the bearing portion (15).

3. An engine with a mechanical governor as set forth in claim 2, wherein a lubricating oil pump (17) is disposed in the front wall (14) of the gear case (13), and a rear end portion (19) of an input shaft (18) of this lubricating oil pump (17) is connected to the front end portion (16) of the balancer shaft (11).

4. An engine with a mechanical governor as set forth in claim 3, wherein an oil filter element (20) is detachably mounted to the gear case (13), and said oil filter element (20) is fluidly connected to the lubricating oil pump (17) through an oil passage (21) formed in the gear case (13).

* * * * *

UNITED STATES PATENT AND TRADEMARK OFFICE

CERTIFICATE OF CORRECTION

PATENT NO. : 5,497,747

DATED : March 12, 1996

INVENTOR(S) : NAKANO et al.

It is certified that error appears in the above-indentified patent and that said Letters Patent is hereby corrected as shown below:

On the cover page:

Item [30] Foreign Application Priority Data

"Japan 5-230662" should read --Japan 5-230622--.

Signed and Sealed this

Twenty-first Day of October 1997

*Attest:*

*Attesting Officer*

BRUCE LEHMAN

*Commissioner of Patents and Trademarks*